US007077303B2

(12) United States Patent
Zega

(10) Patent No.: US 7,077,303 B2
(45) Date of Patent: Jul. 18, 2006

(54) HOLDER FOR CARRYING A TOOL

(76) Inventor: Ronald P. Zega, 16716 Bainbury St., Canyon Country, CA (US) 91387

( * ) Notice: Subject to any disclaimer, the term of this patent is extended or adjusted under 35 U.S.C. 154(b) by 395 days.

(21) Appl. No.: 10/443,288

(22) Filed: May 21, 2003

(65) Prior Publication Data

US 2004/0232187 A1 Nov. 25, 2004

(51) Int. Cl.
*A45F 5/00* (2006.01)

(52) U.S. Cl. ..... 224/673; 224/242; 224/904

(58) Field of Classification Search ..... 224/673, 224/677, 678, 234, 247, 248, 268, 269, 904
See application file for complete search history.

(56) References Cited

U.S. PATENT DOCUMENTS

| | | | | |
|---|---|---|---|---|
| 3,599,847 | A | 8/1971 | Danielson | |
| 4,106,679 | A | 8/1978 | Hillinger | |
| 4,358,036 | A | 11/1982 | Maltais | |
| 4,372,468 | A * | 2/1983 | Harvey | 224/268 |
| 4,638,530 | A | 1/1987 | Perry | |
| 4,645,104 | A | 2/1987 | Vokaty | |
| 4,757,927 | A | 7/1988 | Rutty | |
| 4,790,461 | A | 12/1988 | Stover | |
| D329,748 | S | 9/1992 | Ehlin | |
| D330,806 | S | 11/1992 | Seber | |
| 5,195,667 | A | 3/1993 | Gallant | |
| 5,248,072 | A | 9/1993 | Jones | |
| 6,102,264 | A | 8/2000 | Redzisz | |
| D452,610 | S | 1/2002 | Schwartzmiller | |
| 6,499,637 | B1 | 12/2002 | Zamarron | |
| 2002/0117521 | A1 | 8/2002 | Brandt | |

* cited by examiner

*Primary Examiner*—Stephen K. Cronin
*Assistant Examiner*—Justin M. Larson
(74) *Attorney, Agent, or Firm*—Kelly Lowry & Kelley LLP

(57) ABSTRACT

A holder for carrying a tool with a head and handle on a tool belt includes a body of single piece construction including a first portion which is generally co-planar with a first axis. The tool holder further includes a part for attaching the body to the tool belt, and a part for supporting the tool such that the head is generally co-planar with a second axis perpendicular to the first axis, and the handle extends at an inclined angle from the first axis away from a user.

10 Claims, 2 Drawing Sheets

HOLDER FOR CARRYING A TOOL

BACKGROUND OF THE INVENTION

This invention relates to a tool holder. More particularly, this invention relates to a tool holder attachable to a belt.

Devices for carrying tools connected to belts and/or belt-supported pouches for carrying various materials such as nails, screws, and tools are prevalent throughout the construction industry. Tools like hammers present problems because they can be bulky when attached to a tool belt, constantly bang into the leg of someone wearing a tool belt as that person walks, and/or otherwise make it uncomfortable for a user to carry the hammer on the tool belt.

Many different types of tool holders have been employed to carry tools. These tool holders come in a variety of forms. However, these tool holders have not solved the problem of bulky tools swinging back and forth and hitting a user repeatedly in the leg as the user moves about. For example, U.S. Pat. No. 4,790,461 discloses an implement holder that holds a hammer on a tool belt. However, this holder does nothing to prevent the handle of the hammer from hitting or otherwise interfering with the movement of the user's leg. In another example, U.S. Pat. No. 5,195,667 discloses a tool holder that holds a hammer on a tool belt. However, this holder also does nothing to prevent the handle of the hammer from hitting or otherwise interfering with the movement of the user's leg.

While tool holders such as those described above may provide means for carrying a tool, such tool holders can always be improved to provide a a means for carrying a tool that does not interfere with the movement of the user.

Accordingly, there is a continuing need for an improved device which provides a convenient securement of a tool such as a hammer along a user's belt or waistband. There is an additional need for a tool holder that secures the tool in an unobtrusive manner. There is a further need for a safety device to carry hand-held tools. The present invention provides these needs and other related advantages.

SUMMARY OF THE INVENTION

The present invention provides a convenient securement of a tool such as a hammer along a user's belt or waistband. The present invention is embodied in the form of a tool holder for carrying a tool with a head and handle on a tool belt. The tool holder includes a body of single piece construction including a first portion which is generally co-planar with a first axis. The tool holder further includes a means for attaching the body to the tool belt, and a means for supporting the tool such that the head is generally co-planar with a second axis perpendicular to the first axis, and the handle extends at an inclined angle from the first axis away from a user.

In one embodiment of the tool holder, the body may include a second portion inclined from the first axis away from the user. The first and second portions may meet at a bend in the body. The attaching means may also be associated with the first portion. The attaching means may include at least two slots for receiving the tool belt therethrough. The supporting means may also include a loop extending from at least one of the first and second portions such that the handle of the tool is insertable through the loop. The second portion may position the handle at angle from the first axis away from the user.

The loop may include an arcuate section shaped to substantially match the shape of the head of the tool such that the head of the tool contacts the arcuate section when the tool is inserted through the loop and thereby maintained in a substantially stationary position.

In another embodiment of the tool holder, the attaching means may be associated with the first portion and may include at least two slots located on the first portion. The slots may be sized and shaped so as to receive the belt.

The attaching means may include at least one spring clip having a curved portion, a straight portion and an angled portion. The curved portion may contact and retain the body against the straight portion such that the straight portion and the body are generally adjacent, and the angled portion is angled from the first axis away from a user.

The supporting means may include a loop extending from the first portion such that the handle of the tool is insertable through the loop. The angled portion of the spring clip may then position the handle at angle from the first axis away from the user.

The loop may include an arcuate section shaped to substantially match the shape of the head of the tool such that the head of the tool contacts the arcuate section when the tool is inserted through the loop, thereby maintaining the tool in a substantially stationary position.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
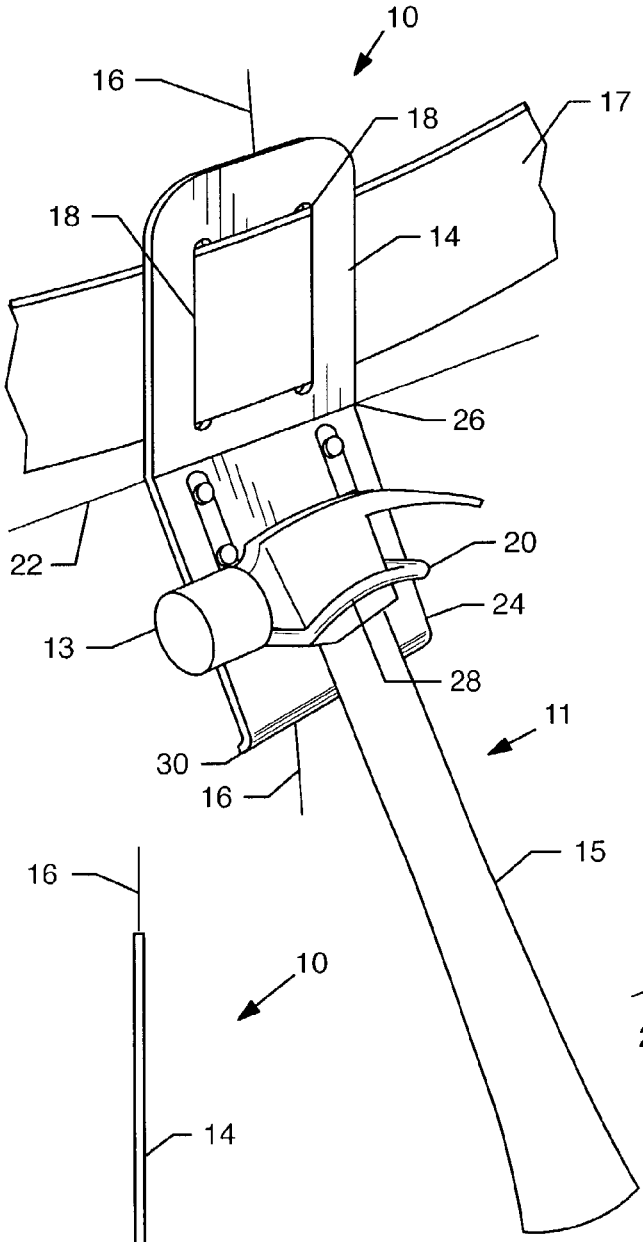
FIG. 1 is an orthogonal view of an embodiment of a tool holder embodying the present invention attached to a user's belt.

The present invention provides a convenient securement of a tool such as a hammer along a user's belt or waistband. The present invention is embodied in the form of a tool holder 10 for carrying a tool 11 with a head 13 and handle 15 on a tool belt 17. The tool holder provides a convenient securement of a tool such as a hammer along a user's belt or waistband. The present invention also provides a tool holder that secures the tool in an unobtrusive manner.

Figure 2:
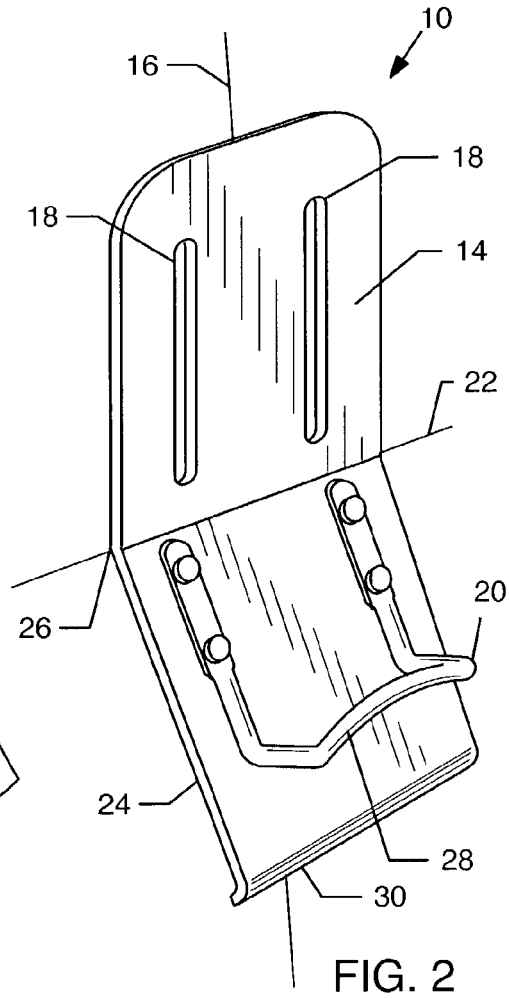
FIG. 2 is an orthogonal view of the tool holder of FIG. 1.
Figure 3:
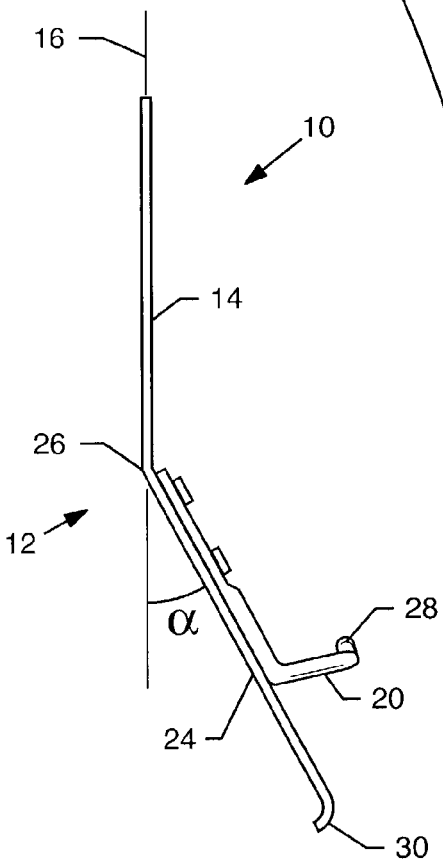
FIG. 3 is an elevation view of the tool holder of FIG. 2.

As shown in the drawings for purposes of illustration, and with reference to FIGS. 1–3, one embodiment of the tool holder 10 includes a body 12 of single piece construction including a generally planar first portion 14 which is generally co-planar with a first axis 16. The tool holder 10 further includes a means 18 for attaching the body to the tool belt 17, and a loop 20 for supporting the tool such that the head 13 is generally parallel with a second axis 22 perpendicular to the first axis 16, and the handle 15 extends at an inclined angle a from the first axis 16 away from a user.

The body 12 includes a generally planar second portion 24 inclined from the first axis 16 away from the user. The first and second portions 14, 24 meet at a bend 26 in the body. The slots 18 are associated with the first portion 14. The slots 18 includes at least two slots for receiving the tool belt 17 therethrough. In the alternative, the tool holder 10 may be attached to the belt 17 even if only one slot 18 is on the body 12.

The loop 20 extends from at least one of the first and second portions 14, 24 such that the handle 15 of the tool 11 is insertable through the loop. The second portion 24 positions the handle 15 at angle α from the first axis 16 away from the user. The is attached to the body 12 in several ways including, without limitation, rivets, screws, welds or the like.

The loop 20 includes an arcuate section 28 shaped to substantially match the shape of the head 13 of the tool 11 such that the head 13 of the tool 11 contacts the arcuate section 28 when the tool is inserted through the loop and thereby maintained in a substantially stationary position.

A bent end 30 is located on an end of the second portion 24 opposite the bend 26. The bend 30 helps prevent the edge of the second portion 24 from catching on the tool 11 or other surface.

In use, a user attaches the tool holder 10 to his or her belt 17 by sliding the belt 17 through the slots 18. As illustrated in FIG. 1–3, the slots 18 are elongated. The user should attach the tool holder 10 to the belt 17 so that the second portion 24 is generally below the first portion 14. The user then inserts the tool 11 into the supporting means 20 by inserting the handle 15 downward through the loop 20 until the bottom of the head 13 rests against the loop 20. The angle α of the second portion 24 causes the handle 15 of the tool 11 to be angled away from the user.

Figure 4:
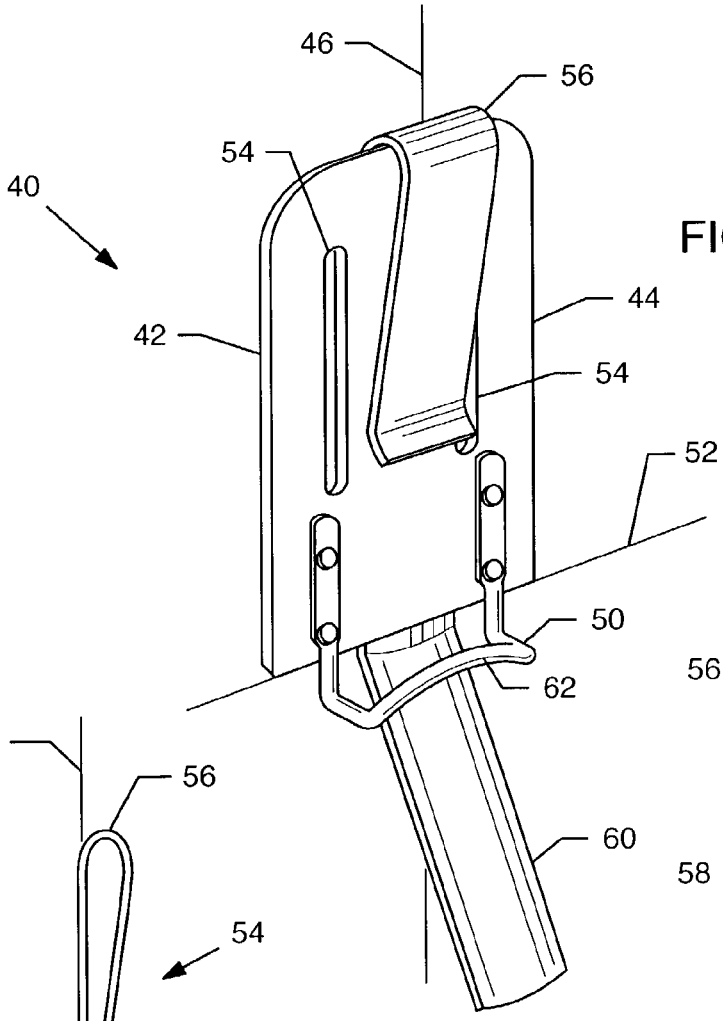
FIG. 4 is an orthogonal view of another embodiment of a tool holder embodying the present invention.
Figure 6:
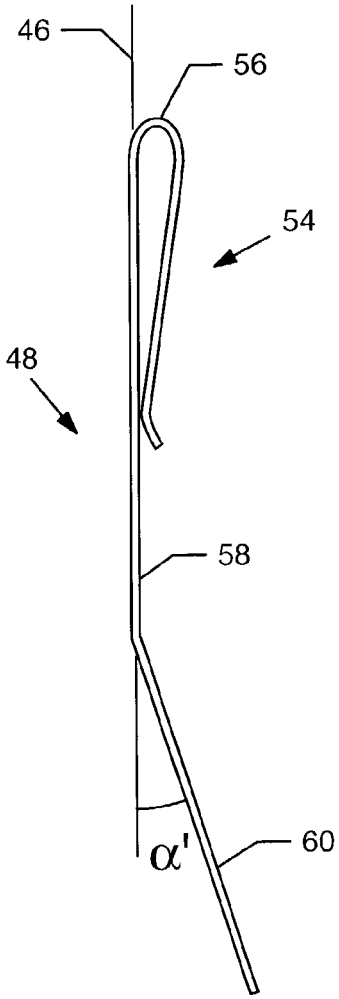
FIG. 6 is an elevation view of the clip of FIG. 5.
Figure 5:
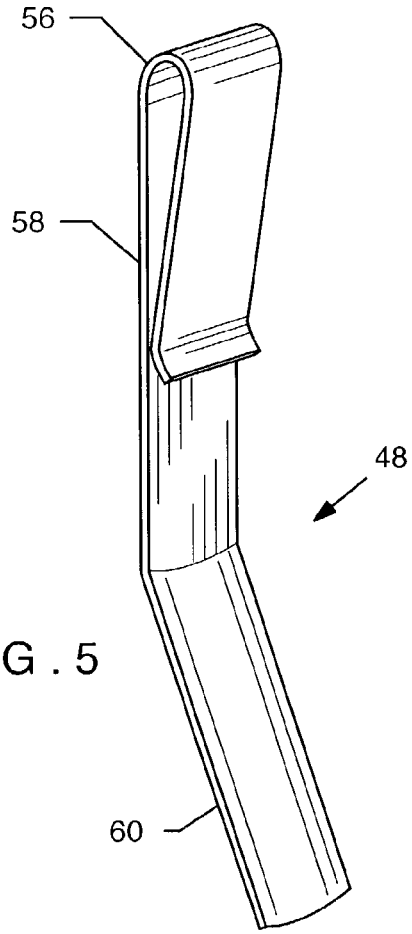
FIG. 5 is an orthogonal view of a clip of the tool holder of FIG. 4.

In accordance with another embodiment of the tool holder 40, as seen in FIGS. 4–6, the tool holder 40 includes a body 42 of single piece construction including a generally planar first portion 44 which is generally co-planar with a first axis 46. The tool holder 40 further includes a clip 48 for attaching the body 42 to the tool belt 17, and a loop 50 for supporting the tool 11 such that the head 13 is generally parallel with a second axis 52 perpendicular to the first axis 46, and the handle 15 extends at an inclined angle from the first axis 46 away from a user.

The clip 48 is in the form of at least one spring clip of single piece construction having a curved portion 56, a straight portion 58 and an angled portion 60. The curved portion 56 contacts and retains the body 42 against the straight portion 58 such that the straight portion 58 and the body 42 are generally adjacent, and the angled portion 60 is angled from the first axis 46 away from a user.

In the alternative, instead of using the clip 48 alone to attach the tool holder 40 to the belt 17, the first portion 44 may include at least two elongated slots 54. The slots may be sized and shaped so as to receive the belt 17.

The loop 50 extends the first portion 44 such that the handle 15 of the tool 11 is insertable through the loop. The loop 50 is located on the first portion 44. The angled portion 60 of the spring clip 54 positions the handle 15 at an angle α' from the first axis 46 away from the user. The loop 50 is attached to the body 12 in several ways including, without limitation, rivets, screws, welds or the like.

The loop 50 includes an arcuate section 62 shaped to substantially match the shape of the head 13 of the tool 11 such that the head 13 contacts the arcuate section 62 when the tool 11 is inserted through the loop, thereby maintaining the tool 11 in a substantially stationary position.

In use, a user attaches the tool holder 10 to his or her belt 17 by sliding the clip 48, in the form of a spring clip, under the user's belt 17. As illustrated in FIG. 1–3, the user then inserts the body 42 so that the belt 17 is sandwiched between the straight portion 58 and the curved portion 56 of the spring clip 54. The user then inserts the tool 11 into the loop 50 by inserting the handle 15 downward through the loop 50 until the bottom of the head 13 rests against the supporting means 50. The angle α' of the angled portion 60 of the spring clip 54 causes the handle 15 of the tool 11 to be angled away from the user.

In the alternative, the user may attach the tool holder 40 to his or her belt 17 by sliding the belt 17 through the elongated slots 49, as described above.

The tool holder 10,40 may be made from various materials, including, without limitation, aircraft aluminum, steel or plastic, ABS, or a combination of the foregoing. In the alternative, the tool holder 10, 40 may be covered with a layer of fabric, made of natural (e.g. cotton) or artificial (e.g., NYLON) fibers. In another alternative, the holders 10, 40 may covered with a layer of enamel, plastic, TEFLON, rubber or the like.

While the tool holder of the present invention has been described in use with respect to a hammer, applications are possible using other tools. For example, the present invention is also applicable to prybars, hatchets and other tools which have elongated handles and angled or transversely extending head pieces.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A tool holder for carrying a tool with a head and handle on a tool belt, the tool holder comprising:

body of single piece construction including a first portion which is generally co-planar with a first axis, and a second portion extending at an inclined angle from the first axis away from a user, wherein the first and second portions meet at a bend in the body;

means for attaching the first portion of the body to the tool belt; and means associated with the second portion of the body, for supporting the tool such that the head is generally parallel with a second axis perpendicular to the first axis, and the handle extends parallel to the inclined angle;

wherein the supporting means includes a loop extending from the second portion, wherein the handle of the tool is insertable through the loop, and wherein the second portion positions the handle at the inclined angle.

2. The tool holder of claim 1, wherein the loop includes an arcuate section shaped to substantially match the shape of the head of the tool, whereby the head of the tool contacts the arcuate section when the tool is inserted through the loop and thereby maintained in a substantially stationary position.

3. The tool holder of claim 1, wherein the attaching means includes at least two slots for receiving the tool belt therethrough.

4. The tool holder of claim 1, wherein an end of the second portion opposite the bend in the body is curved away from the tool.

5. A tool holder for carrying a tool with a head and handle on a tool belt, the tool holder comprising:

a body of single piece construction including a first portion which is generally co-planar with a first axis;

means for attaching the body to the tool belt; and means for supporting the tool such that the head is generally parallel with a second axis perpendicular to the first axis, and the handle extends at an inclined angle from the first axis away from a user; wherein the attaching means includes at least one spring clip having a curved portion, a straight portion and an angled portion, wherein the curved portion contacts and retains the body against the straight portion such that the straight portion and the body are generally adjacent, and the angled portion is angled from the first axis away from a user.

6. The tool holder of claim 5, wherein the supporting means includes a loop extending from the first portion, wherein the handle of the tool is insertable through the loop and the angled portion of the spring clip positions the handle at angle from the first axis away from the user.

7. The tool holder of claim 6, wherein the loop includes an arcuate section shaped to substantially match the shape of the head of the tool, whereby the head of the tool contacts the arcuate section when the tool is inserted through the loop and thereby maintained a substantially stationary position.

8. A tool holder for carrying a tool with a head and handle on a tool belt, the tool holder comprising:

a body of single piece construction including a first portion which is generally co-planar with a first axis;

means for attaching the body to the tool belt and associated with the first portion, wherein the attaching means includes at least two slots located on the first portion and the slots are sized and shaped so as to receive the belt; and means for supporting the tool such that the head is generally co-parallel with a second axis perpendicular to the first axis, and the handle extends at an inclined angle from the first axis away from a user, and wherein the attaching means includes at least one spring clip having a curved portion, a straight portion and an angled portion, wherein the curved portion contacts and retains the body against the straight portion such that the straight portion and the body are generally adjacent, and the angled portion is angled from the first axis away from a user.

9. The tool holder of claim 8, wherein the supporting means includes a loop extending from the first portion, wherein the handle of the tool is insertable through the loop and the angled portion of the spring clip positions the handle at angle from the first axis away from the user.

10. The tool holder of claim 9, wherein the loop includes an arcuate section shaped to substantially match the shape of the head of the tool, whereby the head of the tool contacts the arcuate section when the tool is inserted through the loop and thereby maintained a substantially stationary position.

* * * * *